United States Patent [19]

Ito

[11] 4,407,622

[45] Oct. 4, 1983

[54] SOIL TRANSPORTING VEHICLE FOR TRANSPORTING SOILS EXCAVATED BY SHIELD MACHINE

[75] Inventor: Toshihiko Ito, Kashiwara, Japan

[73] Assignee: Okumura Corporation, Osaka, Japan

[21] Appl. No.: 264,614

[22] Filed: May 18, 1981

[51] Int. Cl.[3] ..... E21D 9/12; E02F 7/10; E21D 9/06; B60P 1/04

[52] U.S. Cl. ..... 414/468; 414/526; 414/398; 299/18; 299/64; 405/138; 405/141

[58] Field of Search ..... 414/468, 526, 416, 507, 414/519, 520, 382, 359, 350, 351, 378, 398; 299/18, 64; 175/62; 405/138, 141-147, 184; 172/32

[56] References Cited

U.S. PATENT DOCUMENTS

| | | | |
|---|---|---|---|
| 2,436,959 | 3/1948 | Ekin et al. | 414/468 X |
| 2,912,126 | 11/1959 | Alspaugh et al. | 414/221 |
| 3,918,604 | 11/1975 | Kersten | 414/526 X |
| 4,040,666 | 8/1977 | Uchida et al. | 299/18 |
| 4,266,902 | 5/1981 | Forsberg | 414/416 X |

FOREIGN PATENT DOCUMENTS

| | | | |
|---|---|---|---|
| 2144212 | 9/1971 | Fed. Rep. of Germany | 414/526 |
| 50-2177275 | 7/1975 | Japan . | |

*Primary Examiner*—Robert B. Reeves

*Assistant Examiner*—James Barlow

*Attorney, Agent, or Firm*—Armstrong, Nikaido, Marmelstein, & Kubovcik

[57] ABSTRACT

A soil transporting vehicle for pressurized receiving and transporting of soil excavated by a shield machine. The vehicle includes a cylindrical soil container having a first opening and a second opening aligned along the longitudinal axis and being pressure-resistant. A soil conveying mechanism is arranged in the container adjacent to the opening for moving the soil axially. A chassis rotatably supports the container and a drive mechanism is provided for rotating the container about its axis from a soil introduction position where the openings are directed upwardly and a soil discharge position where the openings are directed downwardly. An inlet for introducing gas under pressure and a pressure regulating valve are provided on the soil container. The pressure is regulated to be substantially equal to that of the pressure compartment of the shield machine. A compressor is connected with the gas inlet. An opening and closing valve is arranged between the compressor and the gas inlet for admitting pressurized gas into the container to raise the pressure to be substantially equal to that of the pressure compartment of the shield machine before the soil is introduced into the soil container from the pressure compartment.

1 Claim, 7 Drawing Figures

FIG. 1
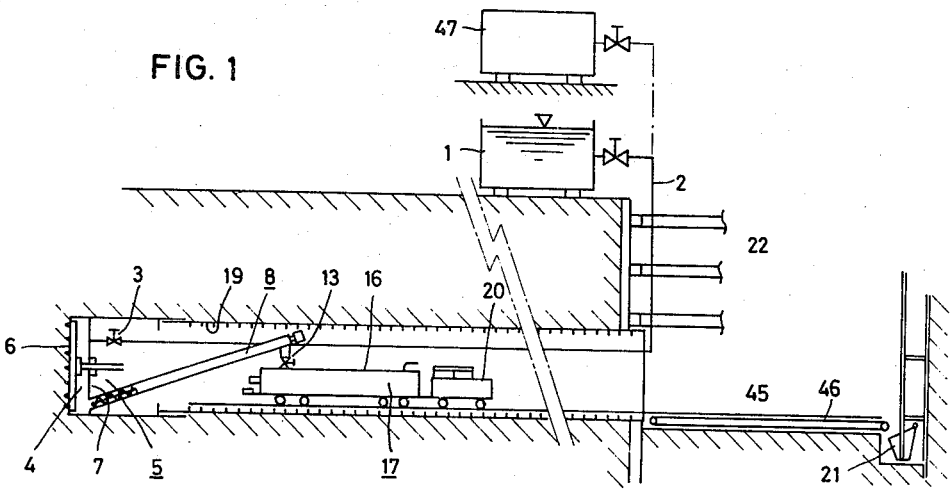
FIG. 2
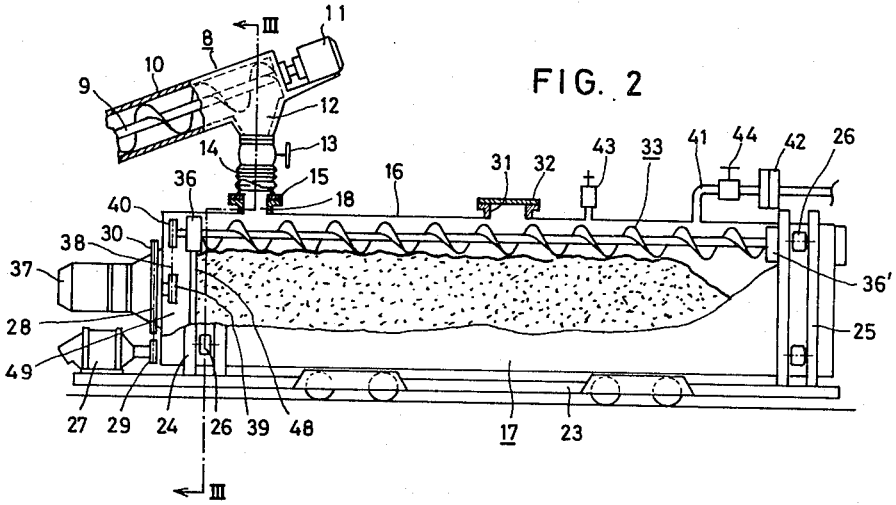
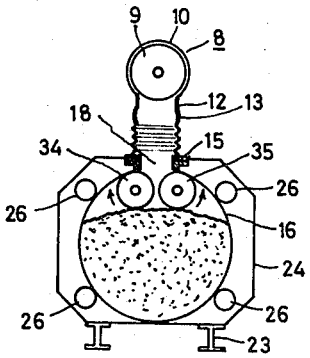
FIG. 3

SOIL TRANSPORTING VEHICLE FOR TRANSPORTING SOILS EXCAVATED BY SHIELD MACHINE

The present invention relates to a soil transporting vehicle for transporting soils excavated by a shield digging machine (hereinafter simply referred to as shield machine). Though not limited thereto, the present invention is especially effective for use in relation with the pressurized slurry shield method or pressurized air shield method wherein slurry or air under pressure is introduced into a pressure compartment defined in the shield machine between a cutter head and a diaphragm located behind the cutter head to prevent the flowing of the underground water and the entrained soils through the slits in the cutter head and through around the periphery of the cutter head into the pressure compartment, thus to prevent also the crumbling of the working face (digging face) of the tunnel.

In order to discharge from the pressure compartment the soils excavated by the shield machine (i.e. by the cutter head of the shield machine) and forced into the pressure compartment through the slits of the cutter head, and to transport thus discharged soils into atmosphere, it has been proposed in the past to sealingly connect one end of a pressure resistant water tight (in the case of pressurized slurry shield method) or air tight (in the case of pressurized air shield method) soil conveyor to the diaphragm to discharge the excavated soils from the pressure compartment and connect the other end of the soil conveyor to a soil introduction opening of a cylindrical pressure resistant soil container of a soil transporting vehicle through an opening and closing valve mounted on said the other end of the soil conveyor. When the excavated soils are to be discharged from the pressure compartment and to be transported into atmosphere, said other end of the soil conveyor is connected to the soil introduction opening of the soil container through said valve. Then the valve is opened and the soil conveyor is driven to introduce the excavated soils into the container. After the soils excavated in one excavation operation corresponding to one pipe section of the tunnel are all introduced into the soil container, the soil conveyor is stopped, the valve is closed and disconnected from said soil introduction opening. At this time the soil transporting vehicle may move to the starting shaft of the tunnel for discharging the soils contained in the soil container through a discharge opening provided in the bottom portion of the container into a bucket elevator arranged in the starting shaft.

In this type of soil transporting vehicle, in order to effectively distribute the introduced soils axially of the elongated soil container, a soil distribution chain conveyor is arranged in the container. The distribution conveyor is raisably supported and it is raised as the introduction of the soils into the container proceeds, to distribute the successively introduced soils throughout the soil container.

As described above, the discharging of the soils from the soil container into the bucket elevator is effected through the discharge opening provided in the bottom portion of the soil container. In this connection, it is to be noted that the distribution conveyor does not contribute to force the soils out of the container through the discharge opening since the distribution conveyor is always positioned close to the upper portion of the soils introduced in the soil container to distribute the soils through the container. Thus, the soils are discharged only by the gravity.

With such discharging only by the gravity, however, the clayey soils can not be discharged satisfactorily since such soils, especially those located in the lower portion of the container, lump into masses which can not pass through the discharge opening of the container. Furthermore, the clayey soils adhered around the discharge opening impede smooth discharge of the soils. Even sandy soils are massed by the soil pressure in the container.

Furthermore, with the above described soil transporting vehicle, interior of the soil container is under atmospheric pressure when it is connected to said soil conveyor so that the pressure in said pressure compartment is suddenly decreased when said connection is effected, sometimes resulting in crumbling of the working surface of the tunnel.

Thus, it is an object of the present invention to provide a new and improved soil transporting vehicle which is able to satisfactorily discharge the soils from the soil container of the soil transporting vehicle.

It is another object of the present invention to provide a new and improved soil transporting vehicle which may be used not only in relation with a normal shield machine which works without the application of pressurized slurry or air but also in relation with the shield machine which works under the application of pressurized slurry or air, i.e. in the pressurized slurry shield method or pressurized air shield method.

It is a further object of the present invention to provide a new and improved soil transporting vehicle which, in the case of the pressurized slurry or air shield method, will not cause substantial pressure decrease in the pressure compartment of the shield machine when the soil container is connected to the soil conveyor.

In order to accomplish the above described objects of the present invention, there is provided a soil transporting vehicle for transporting the soils excavated by a shield machine, comprising a cylindrical soil container having soil introduction and discharge opening means, soil conveying means arranged in the soil container adjacent to said opening means for moving the soils in the soil container axially thereof, a chassis for supporting the soil container rotatably about the longitudinal axis thereof, and drive means for rotating the soil container about said axis between a soil introduction position wherein said opening means is directed upwardly and a soil discharge position wherein said opening means is directed downwardly.

In an embodiment of the present invention, said soil conveying means comprises a pair of reversible screw conveyors extending axially of said soil container and arranged in side by side relation. These screw conveyors are rotated in the opposite direction. In a further embodiment of the present invention, the soil conveying means comprises a reversible chain conveyor having a plurality of scoop members spaced along the chain conveyor.

At least when the soil transporting vehicle of the present invention is to be used in relation with the pressurized slurry or air shield method, said soil container is made pressure resistant so as to withstand the pressure transmitted from the pressure compartment of the shield machine through said soil conveyor when the container is connected to the pressure compartment through the soil conveyor.

Furthermore, at least when the soil transporting vehicle is to be used in relation with the pressurized slurry or air shield method, said soil container, in a preferred embodiment, is provided with an inlet for introducing gas under pressure into the soil container before the introduction of the soils into the container.

According to this embodiment, the soil container may be prepressurized to a level equal or substantially equal to the pressure level in the pressure compartment so that when the soil container is connected to the compartment through the soil conveyor, there will be substantially no pressure decrease produced in the compartment.

The soil introduction and discharge opening means may comprise a single opening which is commonly used for the introduction and discharge of the soils.

In another embodiment, said opening means comprises a first and second openings aligned axially of the soil container, the first opening is commonly used for the introduction and discharge of the soils into and from the container, respectively, and the second opening is used only for the discharge of the soils from the container.

In a still further embodiment, said opening means comprises a first and a second openings aligned axially of the soil container, the first opening is used only for the introduction of the soils into the container and the second opening is used only for the discharge of the soils from the container.

The soil introduction and discharge opening means may comprise other arrangement of openings for the introduction and discharge of the soils into and from the soil container, respectively. What is required for this opening means is that it can introduce and discharge the soils into and from the container, respectively.

These and other objects and features of the present invention will be better understood upon consideration of the following detailed description and the accompanying drawings, in which:

FIG. 1 is a sectional view showing a tunnel under construction by means of the pressurized slurry shield method and also showing a soil transporting vehicle according to the present invention located in the tunnel;

FIG. 2 is a partially broken away side elevational view of a soil transporting vehicle according to the present invention, which is in its soil introducing position;

FIG. 3 is a cross-sectional view along the line III—III of FIG. 2;

Figure 4:
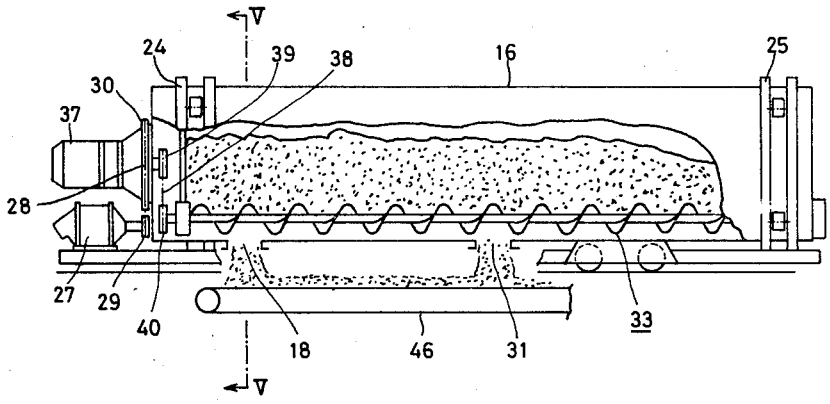
FIG. 4 is a side elevational view similar to FIG. 2 but wherein the vehicle is in its soil discharge position.

Referring now to the drawings, and more particularly to FIGS. 1 and 2, a tunnel which is being constructed by the pressurized slurry shield method is illustrated.

In FIGS. 1 and 2, the reference numeral 1 designates a slurry storage tank placed on the ground, from which the slurry is fed through a conduit 2 and a pressure regulating valve 3 into a pressure compartment 4 defined in a shield machine 5 between a cutter head 6 and a diaphragm 7 located behind the cutter head 6. The pressurized slurry in the pressure compartment 4 prevents the flowing of the underground water and the entrained soils through the slits in the cutter head 6 and through around the periphery of the cutter head 6 into the pressure compartment 4, thus prevents also the crumbling of the working face of the tunnel. The reference numeral 8 designates a pressure resistant water tight soil conveyor having its one end sealingly connected to the diaphragm 7 in communication with inside the pressure compartment 4. The soil conveyor 8 may comprise a screw conveyor 9 rotatably held in a sheath 10 and rotatively driven by an electric motor 11. To an outlet 12 at the other end of the soil conveyor 8 is sealingly connected an opening and closing valve 13 of which outlet side, in turn, is connected to an expandable and contractable chute 14 having a flanged coupling 15. When the soils excavated by the shield machine 5 is to be discharged from the pressure compartment 4 and introduced into a cylindrical soil container 16 of a soil transporting vehicle 17, the flanged coupling 15 is connected to an opening 18 provided in the wall of the soil container 16 and the valve 13 is opened. Then the soil conveyor 8 is driven. When the soils excavated in one excavation operation corresponding to one pipe section 19 of the tunnel have been discharged from the pressure compartment 4 and introduced into the soil container 16, the soil conveyor 8 is stopped and the flanged coupling 15 is disconnected from said opening 18, and the soil transporting vehicle 17 is moved by means of a tractor 20 to a soil discharging location for discharging the soils contained in the soil container 16 into a bucket elevator 21 arranged in the starting shaft 22. The reference numeral 23 designates a chassis for supporting the soil container 16. Such construction and operation is prior known as disclosed in Japanese Patent Publication No. 21772/75.

According to the present invention, the cylindrical soil container 16 is supported rotatably about its axis on the chassis 23. For this purpose, the chassis 23 comprises at least two supporting frames 24 and 25 arranged adjacent to the opposite axial ends of the soil container 16 and roller means 26 mounted on the respective frames 24 and 25 in contact with the container 16. The soil container 16 is rotatively driven by means of an electric or hydraulic motor 27 mounted on the chassis 23 through a chain 28 spanning a chain wheel 29 secured to the shaft of the motor 27 and another chain wheel 30 fixed to the central portion of one end wall of the soil container 16.

The soil container 16 comprises soil introduction and discharge opening means which comprises, in the disclosed embodiment, the above described opening 18 and another opening 31 which is normally closed by a removable lid 32 and aligned with the first opening 18 axially of the container 16. As described hereinafter, the first opening is commonly used for the introduction of the soils into and discharge of the soils from the container 16, respectively. The second opening 31 is used only for the discharge of the soils from the container 16.

Furthermore, according to the present invention, soil conveying means 33 is arranged in the soil container 16 adjacent to said soil introduction and discharge opening means 18 and 31 for moving the soils in the container 16 axially thereof. In the disclosed embodiment, the soil conveying means 33 comprises a pair of reversible screw conveyors 34 and 35 arranged in side by side relation (FIG. 3) and extending axially of the container 16 through substantially entire length thereof. The screw conveyors 34 and 35 are rotatably supported by bearing means 36 and 36' arranged in the opposite end portions of the container 16. The bearing means 36 is mounted on a partition 48 which defines a chamber 49 sealed against the soils in the container 16, and the other bearing means 36' is mounted on the other end wall of the container 16.

The screw conveyors 34 and 35 are rotatively driven in opposite direction as shown by the arrows in FIG. 3 by an electric or hydraulic motor 37 secured to said one end wall of the container 16 through a chain 38 spanning a chain wheel 39 secured to the shaft of the motor 37 and chain wheels 40 secured to the shafts of the respective screw conveyors 34 and 35. The chain wheels 39, 40 and the chain 38 are arranged in the chamber 49 so that these elements are protected from contamination by the soils. Alternatively, these elements may be arranged outside the container 16. In this case, the partition 48 may be omitted.

The soil container 16 is provided with an inlet 41 for a gas (e.g. air) under pressure and a pressure regulating valve 43 for regulating the pressure in the container 16. The inlet 41 is connected through a coupling 42 and an opening and closing valve 44 to a compressor (not shown in the drawings) carried by the tractor 20.

When the soil is to be introduced into the soil container 16 the flanged coupling 15 is sealingly connected to the opening 18 of the container 16. Then the valve 44 is opened to introduce pressurized gas such as air from the compressor into the container 16 to raise the pressure inside the container 16 equal or substantially equal to that of the pressure compartment 4. At this time the valve 44 is closed and the inlet 41 is disconnected from the compressor by releasing the coupling 42. Then the valve 13 is opened and the soil conveyor 8 is driven by the motor 11. It will be easily understood that the opening of the valve 13 does not cause substantial pressure variation or decrease in the pressure compartment 4 since the pressure inside the container 16 has already been increased to a level equal or substantially equal to that of the compartment 4. After the soils excavated in one excavation operation have been introduced into the container 16, the soil conveyor 8 is stopped, the valve 13 is closed and the valve 44 is opened to bring inside the container 16 into atmospheric pressure. Then the flanged coupling 15 is released to disconnect the opening 18 from the chute 14 and the lid 32 is removed. During the introduction of the soils into the container 16, the screw conveyors 34 and 35 are driven to distribute the introduced soils throughout the container 16.

Then the soil transporting vehicle 17 comprising the soil container 16 thus containing the soils therein is moved to the soil discharge location 45 wherein a belt conveyor 46 is arranged.

Figure 5:
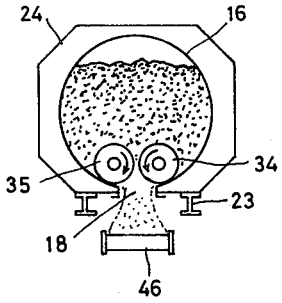
FIG. 5 is a cross-sectional view along the line V—V of FIG. 4.

When the soil transporting vehicle 17 has arrived at the soil discharge location 45, the motor 27 is energized to rotate the soil container 16 by 180 angular degrees from soil introduction position wherein the soil introduction and discharge opening means 18 and 31 is directed upwardly (FIGS. 2 and 3) into soil discharge position wherein said opening means is directed downwardly (FIGS. 4 and 5). The rotational direction of the screw conveyors 34 and 35 is repeatedly reversed to loosen and to move the soils to the openings 18 and 31 to discharge the soils therethrough onto the conveyor 46 which conveys the discharged soils to the bucket elevator 21. During the discharge of the soils onto the conveyor 46, the soil container 16 may be repeatedly oscillated by means of the motor 27 about the axis of the container for a certain angular degrees to promote the discharge of the soils. When the soils in the container 16 have been discharged into the conveyor 46, the motor 27 is again energized to rotate the container 16 into its soil introduction position and the vehicle 17 is returned to the original position for being connected with the soil conveyor 8. The lid 31 is covered again and the inlet 41 is connected with said compressor through the coupling 42.

As will be understood from the above, the soil conveying means 33 becomes located in the bottom portion of the soil container 16 when it is rotated into the soil discharge position so that the soils contained in the container 16 are forcedly moved and discharged through the openings 18 and 31 by the soil conveying means 33. Furthermore, the masses of the soils are broken into smaller masses or pieces by the soil conveying means 33 so that the soils are easily discharged through the openings 18 and 31.

In the disclosed embodiment, the opening 18 serves commonly for the introduction and discharge of the soils and the opening 31 only for the discharge. In this case, if desired, the opening 31 may be omitted. In another arrangement the opening 18 may serve only for the introduction and the opening 31 only for the discharge. Further, more than two openings may be provided to introduce or discharge the soils through a plurality of openings. When an opening only for the soil discharge is provided, such opening may be arranged in an end wall of the soil container adjacent to the end of the soil conveying means 33. What is required for the soil introduction and discharge opening means is that it is able to introduce and discharge soils in said soil introduction position and discharge position, respectively, of the soil container.

The soil transporting vehicle according to the present invention may be similarly used in the pressurized air shield method wherein the air under pressure is fed from an air compressor 47 (FIG. 1) on the ground to the pressure compartment 4 through the conduit 2. In this case, the sheath 10 of the soil conveyor 8 and the soil container 16 are made air tight. Furthermore, the vehicle according to the present invention may be used in the normal shield method wherein the pressurized slurry of air is not used. In this case, the sheath 10 and the container 16 will not be required to be air or water tight and to be pressure resistant. The gas inlet 41 may be omitted.

Figure 7:
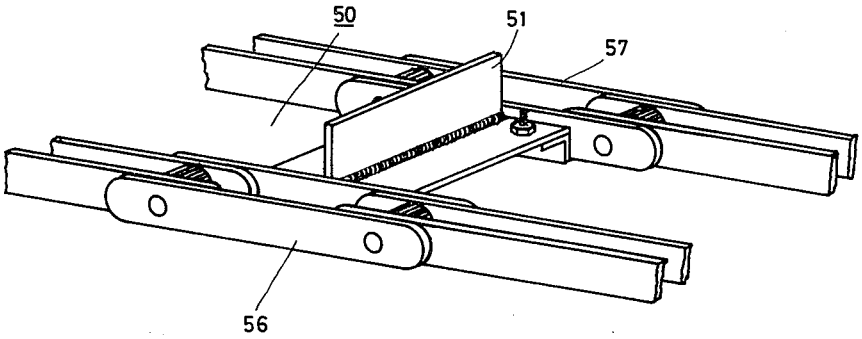
FIG. 7 is a perspective view of a part of the chain conveyor of FIG. 6.
Figure 6:
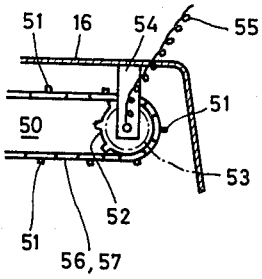
FIG. 6 is a partial sectional view of the soil transporting vehicle according to the present invention showing the use of a chain conveyor for moving the soils in a soil container of the vehicle.

Referring now to FIGS. 6 and 7, another embodiment of the present invention is shown therein. In this embodiment, as the soil conveying means 33, a chain conveyor 50 is used instead of the screw conveyors 34 and 35. The chain conveyor 50 comprises a pair of chains 56 and 57 between which a plurality of scoop members 51 are fixed by a suitable means. The chains 56 and 57 are driven by a pair of toothed pulleys 52 arranged at the opposite sides of an electric motor 53 and fixed to the drive shaft thereof. The motor 53 is supported from the soil container 16 by means of a bracket 54 and suitably energized through wire 55 from outside the container 16. Such chain conveyor 50 is also effective like the screw conveyors 34 and 35 to distribute the introduced soils in the soil container 16 during the soil introduction and to force the soils through the openings 18 and 31 during the soil discharge.

While the principles of the present invention have been described above in connection with specific embodiments, it is to be easily understood that this description is made only by way of example and not as a limitation of the scope of the invention.

For instance, though the soil container 16 has been described as it has a capacity for containing the soils pipe section 19, the capacity of one soil container 16 may be larger than or smaller than this, and also any number of the vehicles 17 may be coupled for being pulled or moved by the tractor 20 as desired or required. The tractor 20, when desired, may be made integral with the chassis 23 of the vehicle.

What is claimed is:

1. A soil transporting vehicle for transporting the soil excavated by a shield machine having a pressure compartment defined therein between a cutter head and a diaphragm located behind the cutter head, into which pressure compartment the pressurized slurry or air is introduced, the vehicle comprising:

a cylindrical soil container having soil introduction and discharge opening means and being pressure resistant, said soil introduction and discharge opening means consisting of a first opening and a second opening in said soil container, said first and second openings being aligned along a longitudinal axis of said soil container, soil conveying means arranged in the soil container adjacent to said opening means for moving the soils in the soil container axially thereof, a chassis for supporting the soil container rotatably about the longitudinal axis thereof, drive means for rotating the soil container about said axis between a soil introduction position wherein said first and second openings are directed upwardly and a soil discharge position wherein said first and second openings are directed downwardly, said soil container being provided with an inlet for introducing gas under pressure into the soil container, and a pressure regulating valve for regulating the pressure in said container to be substantially equal to that of said pressure compartment, a compressor connected with said gas inlet for introducing said pressurized gas into said soil container through the gas inlet, opening and closing valve means arranged between said compressor and said gas inlet for admitting said pressurized gas into said soil container to raise the pressure inside the soil container to be substantially equal to that of said pressure compartment before the soil is introduced into the soil container.

* * * * *